United States Patent [19]

Mills et al.

[11] 4,217,988

[45] Aug. 19, 1980

[54] NON-REFILLABLE POURER FITMENT

[75] Inventors: Frederick Mills, North Walsham; Eric T. Hopley, Poringland; Raymond D. Curtis, Northfields; Patrick M. Wraighte, Buxton, all of England

[73] Assignee: U.G. Closures & Plastics Limited, Middlesex, England

[21] Appl. No.: 951,251

[22] Filed: Oct. 13, 1978

[30] Foreign Application Priority Data

Oct. 20, 1977 [GB] United Kingdom ..... 43701/77

[51] Int. Cl.[2] ..... B65D 49/02

[52] U.S. Cl. ..... 215/21; 215/253; 222/541

[58] Field of Search ..... 222/147, 153, 541, 563, 222/564, 566, 567, 569, 476; 215/14, 17, 20, 21, 250, 251, 253, DIG. 1

[56] References Cited

U.S. PATENT DOCUMENTS

| | | | |
|---|---|---|---|
| 1,036,412 | 8/1912 | Arnavat | 215/21 |
| 2,038,392 | 4/1936 | Wandell et al. | 215/21 |
| 2,141,174 | 12/1938 | Davis | 215/21 |
| 2,260,156 | 10/1941 | Wandell | 215/21 |
| 2,378,919 | 6/1938 | Fisher | 215/21 |
| 3,329,294 | 7/1967 | Bichon | 215/20 |
| 3,810,558 | 5/1974 | Crisp et al. | 215/250 |

*Primary Examiner*—H. Grant Skaggs

*Attorney, Agent, or Firm*—Cushman, Darby & Cushman

[57] ABSTRACT

There is described a non-refillable pourer fitment for the neck of a container comprising inner and outer parts captively attached to each other, a valve member located and movable in a longitudinal bore in the inner part and the outer part being formed with a longitudinal bore at its inner end and a dispensing aperture at its outer end, the longitudinal bore in the outer part varying in radius along its length from a portion of relatively large radius to a portion of relatively small radius, an obturator disc intermediate said portion of relatively small radius and said outer end having a radius greater than said relatively small radius. An inwardly extending peg on the obturator disc suitably controls the limit of movement of the valve member, and the obturator disc is preferably attached through spaced frangible stays to an annular ring adapted to fit tightly within the entrance of the bore of a container to which the fitment is fitted.

4 Claims, 5 Drawing Figures

NON-REFILLABLE POURER FITMENT

This invention relates to fitments for bottles and other containers, and particularly to such fitments which allow the contents of the container to be dispensed by pouring but prevent the re-filling of the container. Such fitments are generally known in the art as "non-refillable pourer fitments".

Such fitments are particularly used in the spirits trade, for example on whisky and gin bottles. It is not unknown for such bottles to be tampered with, for example by emptying a proportion of their contents and re-filling them with, say, water. The use of non-refillable pourer fitments to a substantial extent prevents this tampering with the contents of the bottles, whilst allowing those contents to be freely dispensed.

Various types of non-refillable pourer fitments are known and used, and they vary in effectiveness. Thus, with certain fitments it is necessary to provide special closure caps to fit over or around the fitment and the container neck; with other fitments, it is possible to "poison" the contents of the containers by means of a high-pressure jet of liquid strategically aimed through the fitment; other fitments can be removed from the bottles by means of hooks or other tools.

It is the object of the present invention to provide a non-refillable pourer fitment which fits inside the bore of the neck of the container and thus does not require the provision of special caps for the container; it is a further object of the invention to provide a non-refillable pourer fitment which cannot be removed from the container, or the removal of which is accompanied by the breaking of the fitment; and it is a further object of the invention to provide a non-refillable pourer fitment through which it is impossible to aim a jet of liquid.

Accordng to one aspect of the invention a non-refillable pourer fitment for the neck of a container comprises inner and outer parts captively attached to each other, a valve member located and movable in a longitudinal bore in the inner part and the outer part being formed with a longitudinal bore at its inner end and a dispensing aperture at its outer end, the longitudinal bore in the outer part varying in radius along its length from a portion of relatively large radius to a portion of relatively small radius, an obturator disc intermediate said portion of relatively small radius and said outer end having a radius greater than said relatively small radius.

According to another aspect of the invention there is provided a non-refillable pourer fitment for the neck of a container wherein an annular portion adapted for flush fitting with the mouth of the container is joined to an inner portion by means of at least one frangible stay whereby relative axial movement between the annular portion and the inner portion breaks the stay.

According to yet a further aspect of the invention there is provided a non-refillable pourer fitment comprising inner and outer parts captively attached to each other wherein the outer part is formed with at least one frangible portion such that relative axial movement between the inner and outer parts causes the outer part to break at the frangible portions(s).

The pourer fitments of the present invention thus suitably consist of three separately formed parts which are subsequently assembled together, namely outer and inner parts and a valve member. The outer and inner parts are preferably made of plastics material, such as for example polyethylene, polypropylene or polystyrene, and are suitably shaped such that they may be snap-fitted together, for example by means of one of the parts having an annular rib which snaps into and is retained in an annular groove formed in the other part.

The valve member is suitably a glass or steel ball the limit of whose movement towards the pouring outlet of the fitment is suitably controlled by a peg integrally formed with the outer part of the fitment.

The pourer fitment of the invention is preferably provided with one or more flexible sealing ribs which in use provide a tight seal against the inside of the bore of the container into which the pourer is fitted. These sealing ribs may be formed integrally with either the outer or the inner part of the fitment.

The invention is illustrated by means of the accompanying drawings, wherein

Figure 1:
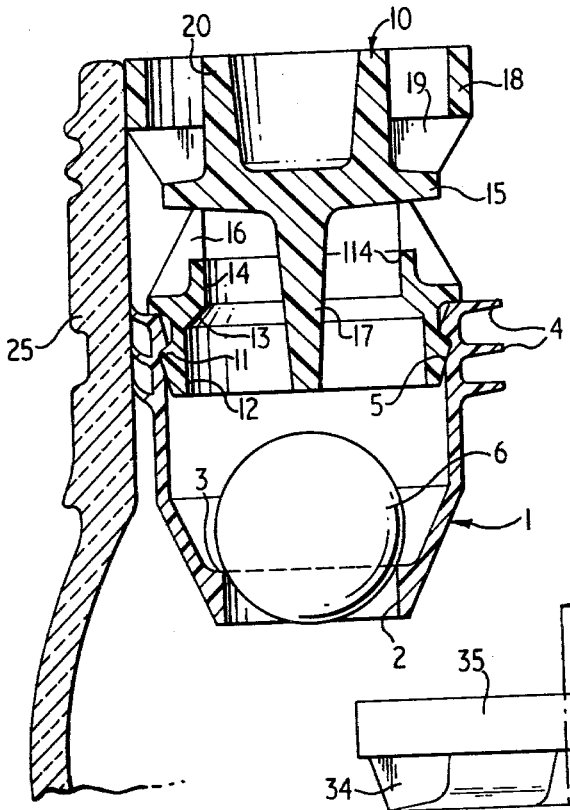
FIG. 1 is a sectional view of a pourer fitment, the left-hand side of the Figure showing the fitment within the neck of a container.

Referring to FIG. 1, the fitment comprises an inner part 1 which is a substantially cylindrical moulding of plastics material, e.g. polyethylene, polypropylene or polystyrene, provided with a circular aperture 2 at its lower end surrounded by an annular valve seat 3. At the upper end of fitment part 1 are moulded three external, flexible, annular ribs 4, and an annular groove 5 is provided at the upper part of the wall of part 1. A ball valve 6, suitably a spherical glass ball, is contained within fitment part 1.

Captively associated with fitment part 1 is fitment part 10, also preferably a plastics moulding. The lower end of part 10 is provided with an annular bead 11 which is snap-fittedly engaged in the groove 5 of fitment part 1. Fitment 10 has at its inner end a longitudinal bore formed of a first portion 12 merging through a ramp 13 into a second portion 14 of radius smaller than that of portion 12. Attached to the inner end of fitment part 10 is an obturator disc 15, this being attached to the inner end of part 10 by means of spaced stays 16. An inwardly projecting peg 17 limits the movement of ball valve 6 in the fitment.

In similar fashion an annular ring 18 is attached to the disc 15 by means of a series of spaced stays 19. The stays 19 are attached at their inner ends to an upstanding annular rib 20. An annular pouring outlet is constituted by the ring 18 and rib 20.

Disc 15 has a greater radius than does the portion 14 of the bore of fitment part 10. The stays 16 and 19 are suitably of relatively thin or frangible material, or alternatively or additionally their points of junction with the disc 15 and ring 18 respectively are made relatively easily frangible.

The fitment is easily assembled by placing the ball valve 6 in fitment part 1 and snap-fitting fitment part 10 thereon. The assembled fitment may then be placed in the bore of the neck 25 of a container (see the left-hand side of the Figure) and the flexible ribs 4 act as sealing fins. Liquid may be dispensed from the container in the normal manner. Ball valve 6 is removed from valve seat 3, and liquid can then pass through aperture 2, between stays 16, between stays 19 and finally between ring 18 and rib 20.

Any attempt to re-fill the container will be thwarted by the ball valve 6, and furthermore any attempt to dislodge ball valve 6 from its seat 3 by means of a high-pressure liquid jet or by the insertion of a wire will not succeed. By forming disc 15 with a radius larger than that of at least part of the bore of the inner part of part 10, a jet of liquid cannot be directed straight onto ball valve 6. The rim 114 formed on portion 14 is a further barrier to the passage of a liquid jet, and also helps to prevent a wire being used to unseat valve 6. Furthermore, any attempt to remove the fitment from the neck of the container, for example by placing a hook around ring 18 or disc 15 and pulling thereon, will result either in the breakage of stays 19 and 16 respectively, or breaking away of those stays from ring 18 and disc 15 respectively.

Figure 2:
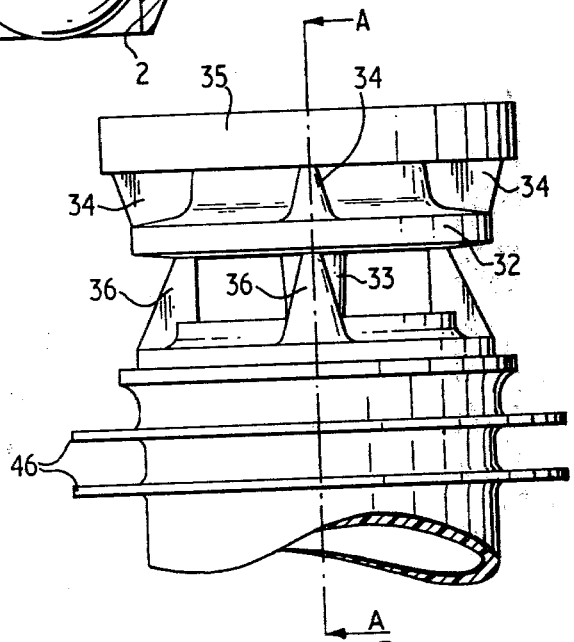
FIG. 2 is a side elevaton of another form of fitment, partially broken away.
Figure 3:
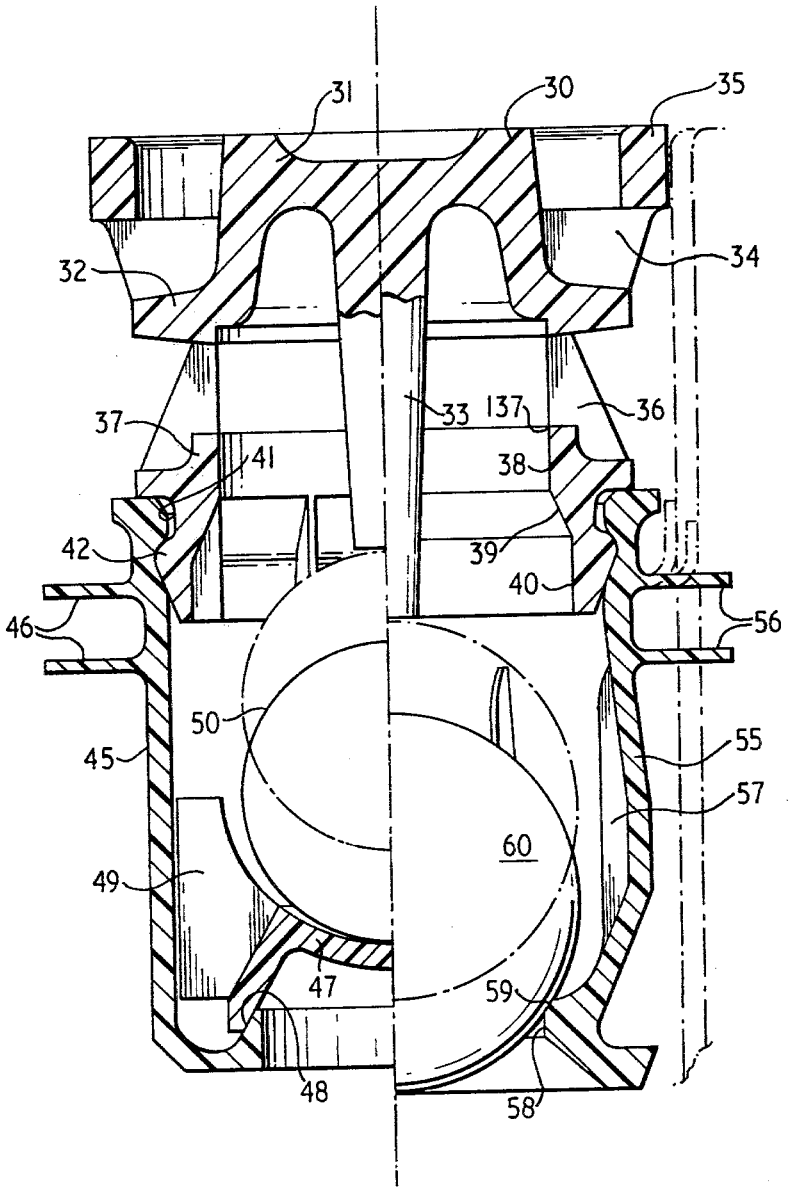
FIG. 3 is a section on the line A—A of FIG. 2.

FIGS. 2 and 3 illustrate different, but similar designs of pourer fitments. FIG. 3 in particular illustrates two different designs of fitment inner parts.

The outer fitment part 30 in each case is a plastics moulding comprising a central obturator 31 provided with an outwardly-directed radial flange 32, and a central peg 33. Frangibly attached to spaced stays 34 on flange 32 is an annular ring 35; and frangibly attached to flange 32 by spaced stays 36 is a cylindrical portion 37 having an upstanding rim 137 and a bore comprising a portion 38 which merges through a ramp 39 with a portion 40. A groove 41 formed externally of part 37 merges with an annular bead 42. Bore portion 38 is of smaller radius than flange 32.

The inner part of the fitment shown on the left-hand side of FIG. 3 comprises a cylindrical moulding 45 provided with flexible ribs 46 and a movable valve 47 adapated for co-operation with a frusto-conical seating 48 formed on the base of moulding 45.

Valve 47 is provided with a series of circumferentially spaced flights 49, which allow the passage of liquid when valve 47 is removed from its closed position. Valve 47 may be used as the sole valve member, or it may be used in conjunction with a ball valve member, e.g. a spherical glass ball 50, acting as a dead weight.

The inner part of the pourer fitment shown on the right-hand side of FIG. 3 comprises a plastics moulding 55 of a slightly different shape from that designated 45, and provided with flexible ribs 56. Internally of the wall of moulding 55 are a series of integrally-formed longitudinally-extending spaced ribs 57, and at the lower end of the moulding is an aperture 58 surrounded by a valve seat 59 on which sits, in closed position of the valve, a spherical glass ball 60.

Figure 4:
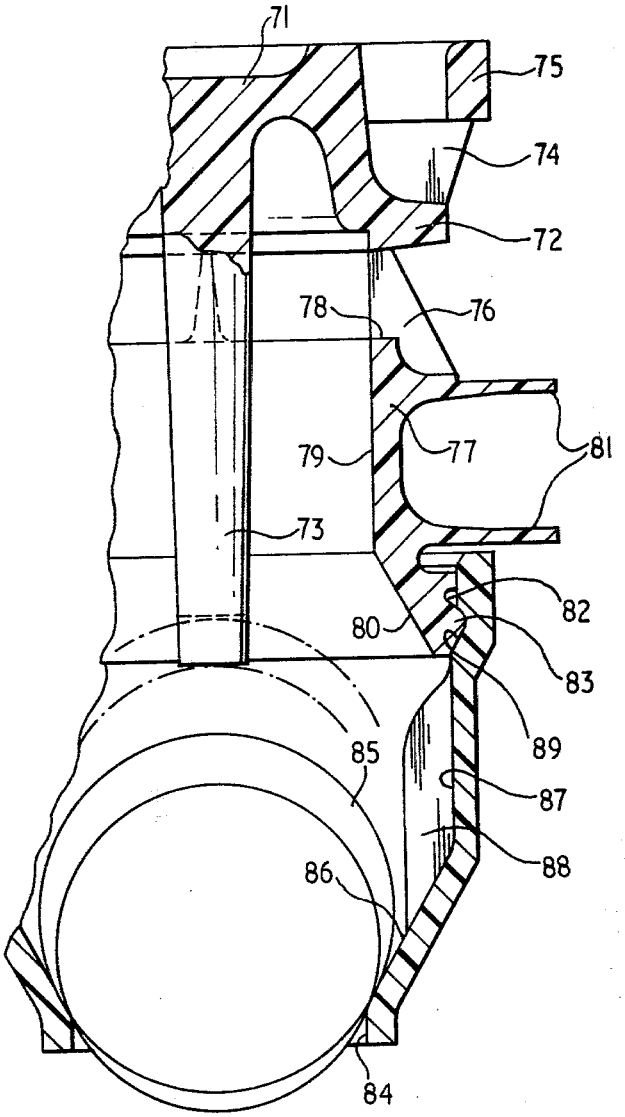
FIG. 4 is a section, similar to that of FIG. 3, showing a modified fitment.
Figure 5:
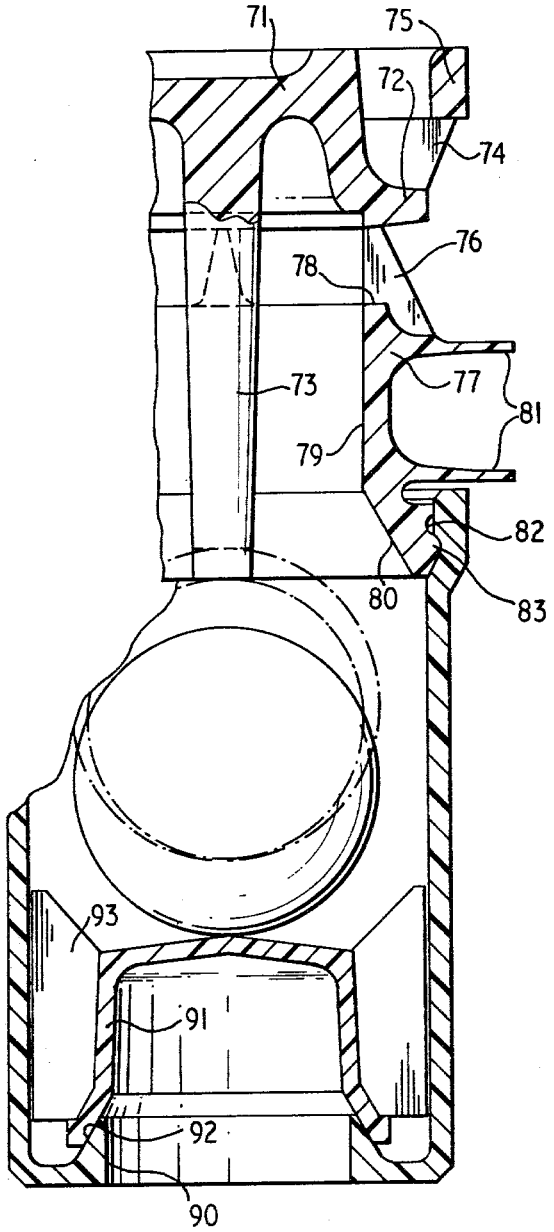
FIG. 5 is a section, similar to that of FIG. 4, showing yet a further embodiment.

The fitments shown in FIGS. 4 and 5 are similar to each other, differing only in the configuration of their inner parts.

The outer part of the fitment shown in each of FIGS. 4 and 5 is broadly similar to that shown in FIGS. 2 and 3, having a central obturator 71 provided with an outwardly-directed radial flange 72 and a central peg 73. Frangibly attached to spaced stays 74 on flange 72 is an annular ring 75; and frangibly attached to flange 72 by spaced stays 76 is a body portion 77 having an upstanding rim 78 and a bore comprising a cylindrical portion 79 merging into a frusto-conical portion 80. The diameter of the bore 79 is smaller than the diameter of flange 72. On the outside of the body portion 77 are two relatively flexible sealing fins 81, beneath the lower of which the body portion is formed with an annular groove 82 merging into an annular bead 83.

The inner part of the fitment of FIG. 4 has a circular aperture 84 at its lower end in which is engaged (in the position shown) a ball valve 85. A frusto-conical wall 86 leads from aperture 84 to a substantially cylindrical portion 87 formed with a series of integrally-formed longitudinally-extending spaced ribs 88. At the upper end of the inner part is an annular groove 89 into which the bead 83 of the outer part is snap-fitted.

The inner part of the fitment shown in FIG. 5 is a cylindrical moulding having an inlet aperture 90 at its lower end and is provided with a movable valve 91 adapted for cooperation with a frusto-conical valve seat 92 formed on the base of the moulding. Valve 91 is provided with a series of circumferentially-spaced flights 93, which allow the passage of liquid when the valve is removed from its seat 93. Valve 91 may if desired be used in conjunction with a ball valve member, acting as a dead weight.

The fitments shown in FIGS. 2 to 5 operate in precisely the same way as does that shown in FIG. 1, and it is important to note that a serious attempt to remove the fitment from the container, resulting in the breaking of the stays 16, 36 or 76 respectively, will not only give clear visual indication of tampering but will also, since the peg 17,33 or 73 respectively will have been broken away, causes the respective valves to seat in sloping portion 13,39 or 80 respectively, thus sealing off the flow and preventing liquid from being poured from the bottle.

We claim:

1. A non-refillable pourer fitment for the neck of a container comprising inner and outer parts captively attached to each other, a valve member located and movable in a longitudinal bore in the inner part and the outer part being formed with a longitudinal bore at its inner end and a dispensing aperture at its outer end, first and second valve seats in said inner and outer parts respectively, an obturator disc frangibly attached to a body portion of the outer part, said body portion including the said longitudinal bore and said second valve seat, and an inwardly extending peg on the obturator disc controlling the limit of movement of the valve member.

2. A fitment as claimed in claim 1 wherein one of the outer and inner parts is provided with an annular rib which snap fits into an annular groove formed in the other of the outer and inner parts.

3. A fitment as claimed in claim 1 wherein the peg is formed integrally with the obturator disc.

4. A fitment as claimed in claim 1 wherein the at least one of the outer and inner parts is formed with external sealing fins.

* * * * *